US011274391B2

(12) United States Patent
Seo et al.

(10) Patent No.: US 11,274,391 B2
(45) Date of Patent: Mar. 15, 2022

(54) WASHING MACHINE AND DIAPHRAGM ASSEMBLY OF WASHING MACHINE

(71) Applicant: SAMSUNG ELECTRONICS CO., LTD., Suwon-si Gyeonggi-do (KR)

(72) Inventors: Jin-ho Seo, Seongnam-si (KR); Hyung-min Kim, Osan-si (KR); Sang-ho Park, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 38 days.

(21) Appl. No.: 16/627,090

(22) PCT Filed: Jun. 26, 2018

(86) PCT No.: PCT/KR2018/007214
§ 371 (c)(1),
(2) Date: Dec. 27, 2019

(87) PCT Pub. No.: WO2019/004691
PCT Pub. Date: Jan. 3, 2019

(65) Prior Publication Data

US 2020/0141045 A1 May 7, 2020

(30) Foreign Application Priority Data

Jun. 28, 2017 (KR) ..... 10-2017-0081859

(51) Int. Cl.
*D06F 39/08* (2006.01)
*D06F 21/02* (2006.01)
(Continued)

(52) U.S. Cl.
CPC ..... *D06F 39/088* (2013.01); *D06F 21/02* (2013.01); *D06F 37/22* (2013.01); *D06F 37/266* (2013.01)

(58) Field of Classification Search
CPC ..... D06F 21/02; D06F 37/22; D06F 37/266; D06F 39/088
See application file for complete search history.

(56) References Cited

U.S. PATENT DOCUMENTS 9,476,157 B2 10/2016 Park et al.
9,512,550 B2 12/2016 Im et al.
(Continued)

FOREIGN PATENT DOCUMENTS

JP 4851988 1/2012
KR 0118302 10/1994
(Continued)

OTHER PUBLICATIONS

Machine translation of JP 4851988 B2 to Yoshinori et al. (Year: 2012).*
(Continued)

*Primary Examiner* — Joseph L. Perrin
(74) *Attorney, Agent, or Firm* — Staas & Halsey, LLP

(57) ABSTRACT

Disclosed is a washing machine capable of preventing noise caused by an assembly failure of a supply hose. The washing machine comprises: a main body including a front frame; a tub provided inside the main body; a diaphragm provided between the tub and the front frame; a nozzle provided at the inner surface of the diaphragm so as to spray water toward the inside of the tub; a nozzle guide provided at the outer surface of the diaphragm, and including a through-hole into which one end of the nozzle is inserted; a supply hose connected to one end of the nozzle protruding through the through-hole; and a fixing member for fixing the supply hose to one end of the nozzle, wherein the nozzle guide includes ribs for preventing a portion of the fixing member from coming in contact with the front frame of the main body.

15 Claims, 18 Drawing Sheets

(51) Int. Cl.
*D06F 37/22* (2006.01)
*D06F 37/26* (2006.01)

(56) References Cited

U.S. PATENT DOCUMENTS

2007/0295037 A1 12/2007 Blomberg et al.
2009/0120140 A1* 5/2009 Choi ..... D06F 58/203 68/5 C
2011/0099727 A1* 5/2011 Kim ..... D06F 34/18 8/137
2011/0100070 A1* 5/2011 Kim ..... D06F 35/006 68/200
2014/0033449 A1* 2/2014 Im ..... D06F 39/088 8/137
2014/0109323 A1* 4/2014 Kim ..... D06F 39/083 8/137
2014/0299164 A1* 10/2014 Zhang ..... D06F 37/28 134/34
2014/0352363 A1* 12/2014 Kim ..... D06F 37/266 68/140
2015/0121969 A1* 5/2015 Lim ..... D06F 39/088 68/131
2015/0128657 A1* 5/2015 Kim ..... D06F 39/088 68/132

FOREIGN PATENT DOCUMENTS

KR 10-2006-0062191 6/2006
KR 10-2008-0016078 2/2008
KR 10-1224390 1/2013
KR 10-1564597 10/2015
KR 10-1627201 6/2016

OTHER PUBLICATIONS

International Search Report dated Oct. 15, 2018, in corresponding International Patent Application No. PCT/KR2018/007214.
Written Opinion of the International Searching Authority dated Oct. 15, 2018, in corresponding International Patent Application No. PCT/KR2018/007214.

* cited by examiner

WASHING MACHINE AND DIAPHRAGM ASSEMBLY OF WASHING MACHINE

REFERENCE TO RELATED APPLICATIONS

This application is a U.S. National Stage Application which claims the benefit under 35 U.S.C. § 371 of International Patent Application No. PCT/KR2018/007214 filed on Jun. 26, 2018, which claims foreign priority benefit under 35 U.S.C. § 119 of Korean Patent Application No. 10-2017-0081859 filed on Jun. 28, 2017 in the Korean Intellectual Property Office, the contents of both of which are incorporated herein by reference.

TECHNICAL FIELD

The disclosure relates to a diaphragm assembly of a washing machine, and more particularly, to a diaphragm assembly of a washing machine including a nozzle for supplying washing water into a drum of a drum-type washing machine and a washing machine including the same.

BACKGROUND ART

In general, washing machines are electric devices removing contaminants from laundry by chemical decomposition and mechanical impacts. The washing machines may be classified largely into a pulsator-type washing machine and a drum-type washing machine based on how to give the impacts to the laundry.

In the pulsator-type washing machine, a laundry tank, in which the laundry is accommodated, and a water storage tank are installed in a vertical direction, and the washing is performed using impacts and frictions caused by the water flow when the pulsator installed on the bottom of the laundry tank is rotated.

In the drum-type washing machine, a drum, in which the laundry is accommodated, and a tub are installed in a horizontal direction, and the washing is performed by dropping the laundry to give impacts to the laundry when the drum is rotated.

When compared to the pulsator-type washing machine in which the rotatable laundry tank is installed in the vertical direction, the drum-type washing machine is widely used because it is capable of reducing a height, maximizing a washing capacity, and reducing tanglement of the laundry after washed.

FIG. 1 is a schematic cross-sectional view of a drum-type washing machine according to the related art.

As illustrated in FIG. 1, the drum-type washing machine 100 includes a tub 110 installed inside a main body 101 for storing washing water, and a drum 120 rotatably installed inside the tub 110 for accommodating the laundry.

The tub 110 is fixed inside the main body 101, and the drum 120 is installed inside the tub 110 in such a manner as to be rotatable by a drive motor 130.

A diaphragm 140 is installed between a front frame 103 of the main body 101 and one end of the tub 110 to prevent the washing water from being leaked. In addition, the diaphragm 140 prevents vibrations of the tub 110, which are caused when the drum 120 is rotated, from being transmitted to the front frame 103 of the main body 101. Therefore, the diaphragm 140 may be formed of a rubber material.

The diaphragm 140 may be provided with a nozzle 150 for supplying the washing water into the tub 110. A supply hose 160 for supplying the washing water is connected to one end of the nozzle 150. The supply hose 160 is fixed to one end of the nozzle 150 by a one-touch hose clamp 170. At this time, the nozzle 150 is installed adjacent to the front frame 103 of the main body 101 for efficiently supplying the washing water.

In the process of assembling the drum-type washing machine 100, when an operator inserts one end of the nozzle 150 into the supply hose 160, and fixes the supply hose 160 to the nozzle 150 using the one-touch hose clamp 170, a push portion 171 of the one-touch hose clamp 170 may be located adjacent to the front frame 103 of the main body 101 as illustrated in FIG. 2. When the push portion 171 of the one-touch hose clamp 170 is adjacent to or in contact with the front frame 103, the push portion 171 of the one-touch hose clamp 170 may collide with the front frame 103 due to the vibrations transferred to the diaphragm 140 during dewatering by the drum-type washing machine 100, thereby causing noise.

When the noise is caused due to the assembly failure of the hose clamp during washing, the drum-type washing machine sold to a consumer may be returned because of the noise problem.

Therefore, there has been a demand for the development cf. the drum-type washing machine that is capable of structurally preventing the noise caused due to the contact between the hose clamp and the front frame during washing.

DISCLOSURE

Technical Problem

The disclosure provides a washing machine capable of structurally preventing an assembly failure of a nozzle and a hose to prevent an occurrence of noise during washing, and a diaphragm assembly for use in the washing machine.

Technical Solution

According to an embodiment of the disclosure, a washing machine includes: a main body including a front frame; a tub provided inside the main body; a diaphragm provided between the tub and the front frame; a nozzle provided at an inner surface of the diaphragm to spray water toward the inside of the tub; a nozzle guide provided at an outer surface of the diaphragm, and including a through-hole into which one end of the nozzle is inserted; a supply hose connected to the one end of the nozzle protruding through the through-hole; and a fixing member configured to fix the supply hose to the one end of the nozzle. The nozzle guide may include a rib configured to prevent a portion of the fixing member from being in contact with the front frame of the main body.

The rib may be formed on an upper surface of the nozzle guide upwardly at a height to interfere with a protrusion of the fixing member.

The rib may be formed in a bar shape on the nozzle guide next to one side of the supply hose to face the front frame of the main body together with the supply hose.

The rib may include two ribs which are linearly symmetrical with respect to a straight line passing through the center of the through-hole in a longitudinal direction of the nozzle guide.

The rib may be formed to be positioned between the supply hose and the front frame, while protruding upwardly from the upper surface of the nozzle guide at a front side thereof adjacent to the front frame of the main body.

The rib may be formed of a plurality of barrier walls arranged at a predetermined interval along a curved line having an identical or similar curvature to the supply hose.

The rib may have an inner surface facing the supply hose and an outer surface facing the front frame of the main body, the inner surface being perpendicular to a lower surface of the nozzle guide and the outer surface being formed as an inclined surface which is inclined downwardly toward the lower surface of the nozzle guide.

The rib may be formed to have an upper end positioned at a middle height of the protrusion of the fixing member.

The rib may include a lateral-side rib and a front-side rib, the lateral-side rib being formed in a bar shape to protrude upwardly from the upper surface of the nozzle guide at a lateral side thereof at the height to interfere with the protrusion of the fixing member, and the front-side rib being formed to protrude upwardly from the upper surface of the nozzle guide at a front side thereof adjacent to the front frame of the main body at the height to interfere with the protrusion of the fixing member.

The fixing member may be a one-touch hose clamp, and the protrusion may be a push portion of the one-touch hose clamp.

The nozzle may include: a connection portion inserted into the through-hole of the nozzle guide and connected to the supply hose; and a spraying portion extending from the connection portion at a predetermined angle. The connection portion may include a first fixing wing inserted into a fixing groove in the nozzle guide and a second fixing wing inserted into a reference groove in the diaphragm.

According to another embodiment of the disclosure, a diaphragm assembly of a washing machine provided between a front frame of a main body of the washing machine and a tub installed inside the main body thereof includes: a diaphragm provided between the tub and the front frame; a nozzle provided at an inner surface of the diaphragm to spray water toward the inside of the tub; a nozzle guide provided at an outer surface of the diaphragm, and having a through-hole into which one end of the nozzle is inserted; a supply hose connected to the one end of the nozzle protruding through the through-hole; and a hose clamp configured to fix the supply hose to the nozzle. The nozzle guide may include a rib configured to prevent a push portion of the hose clamp from being in contact with the front frame of the main body.

Advantageous Effects

According to the washing machine of the disclosure having the configuration described above, in case that the washing machine is structured such that the supply hose is installed adjacent to the front frame of the main body, and the protrusion of the fixing member fixing the supply hose is possibly in contact with the front frame, it is possible to fundamentally prevent an occurrence of an assembly failure causing the protrusion of the fixing member to be assembled in contact with the front frame in the washing machine assembly process. Therefore, the washing machine according to an embodiment of the disclosure is capable of preventing noise caused by the assembly failure of the fixing member when the washing machine is used.

BEST MODE

Hereinafter, embodiments of a washing machine and a diaphragm assembly of the washing machine according to the disclosure will be described in detail with reference to the accompanying drawings.

It should be understood that the embodiments described below are provided as examples to help the understanding of the disclosure, and the disclosure may be variously modified in different forms from the embodiments described herein. However, in the following description of the disclosure, detailed explanations and specific illustrations of known related functions or components may be omitted when it is determined that the detailed description thereof may unnecessarily obscure the subject matter of the disclosure. Further, in order to help the understanding of the disclosure, the accompanying drawings are not illustrated according to actual scales, but some components may be exaggerated in size.

Figure 1:
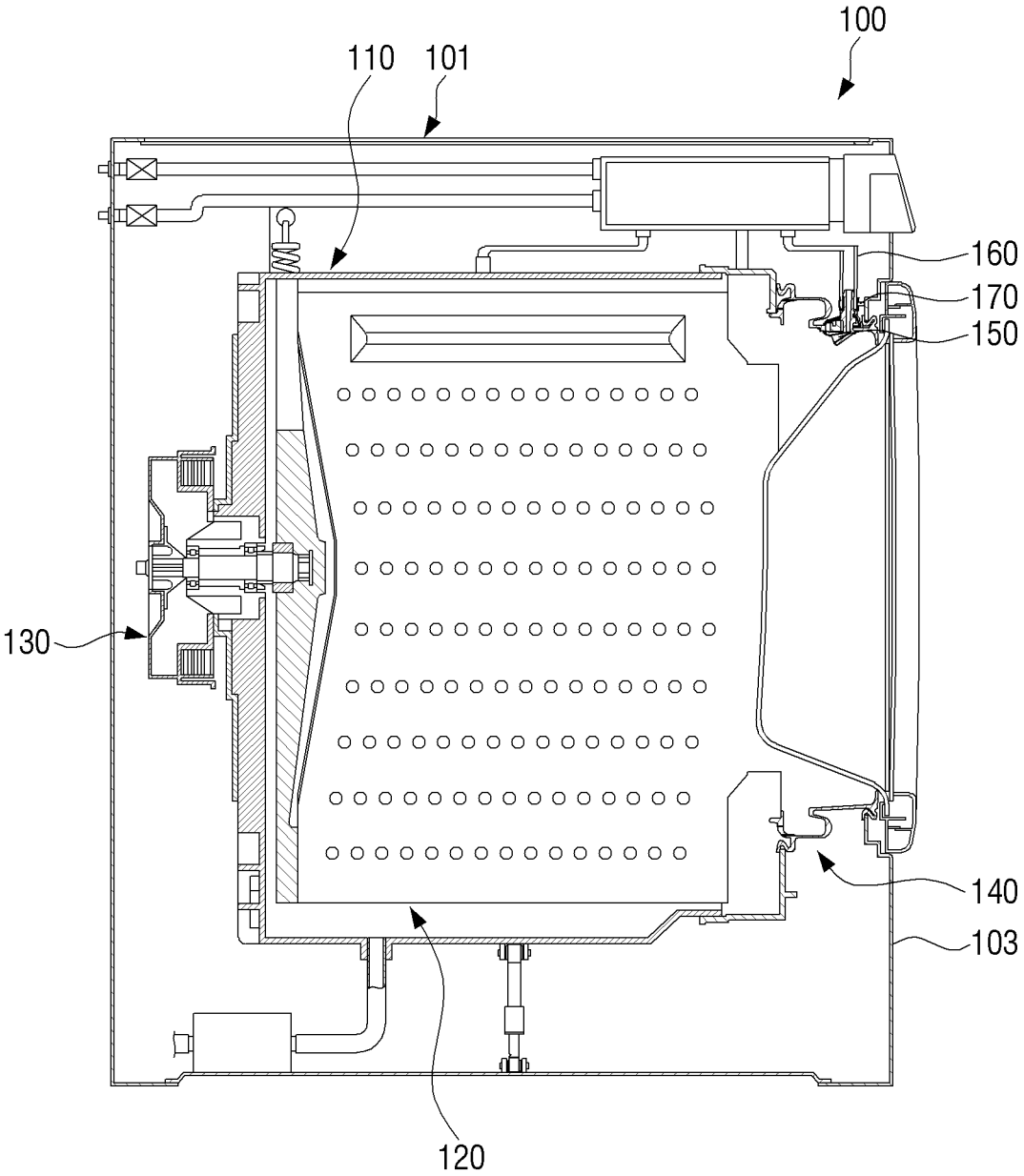
FIG. 1 (PRIOR ART)
FIG. 1 is a cross-sectional view schematically illustrating a drum-type washing machine according to the related art.
Figure 2:
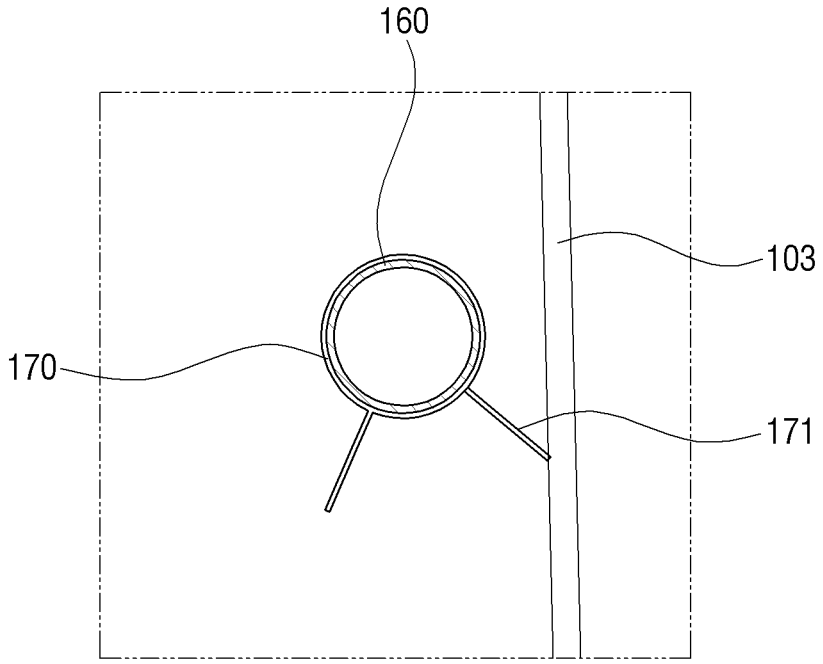
FIG. 2 (PRIOR ART)
FIG. 2 is a view illustrating a state in which a push portion of a hose clamp and a front frame of a main body are in contact with each other in the drum-type washing machine according to the related art of FIG. 1.
Figure 3:
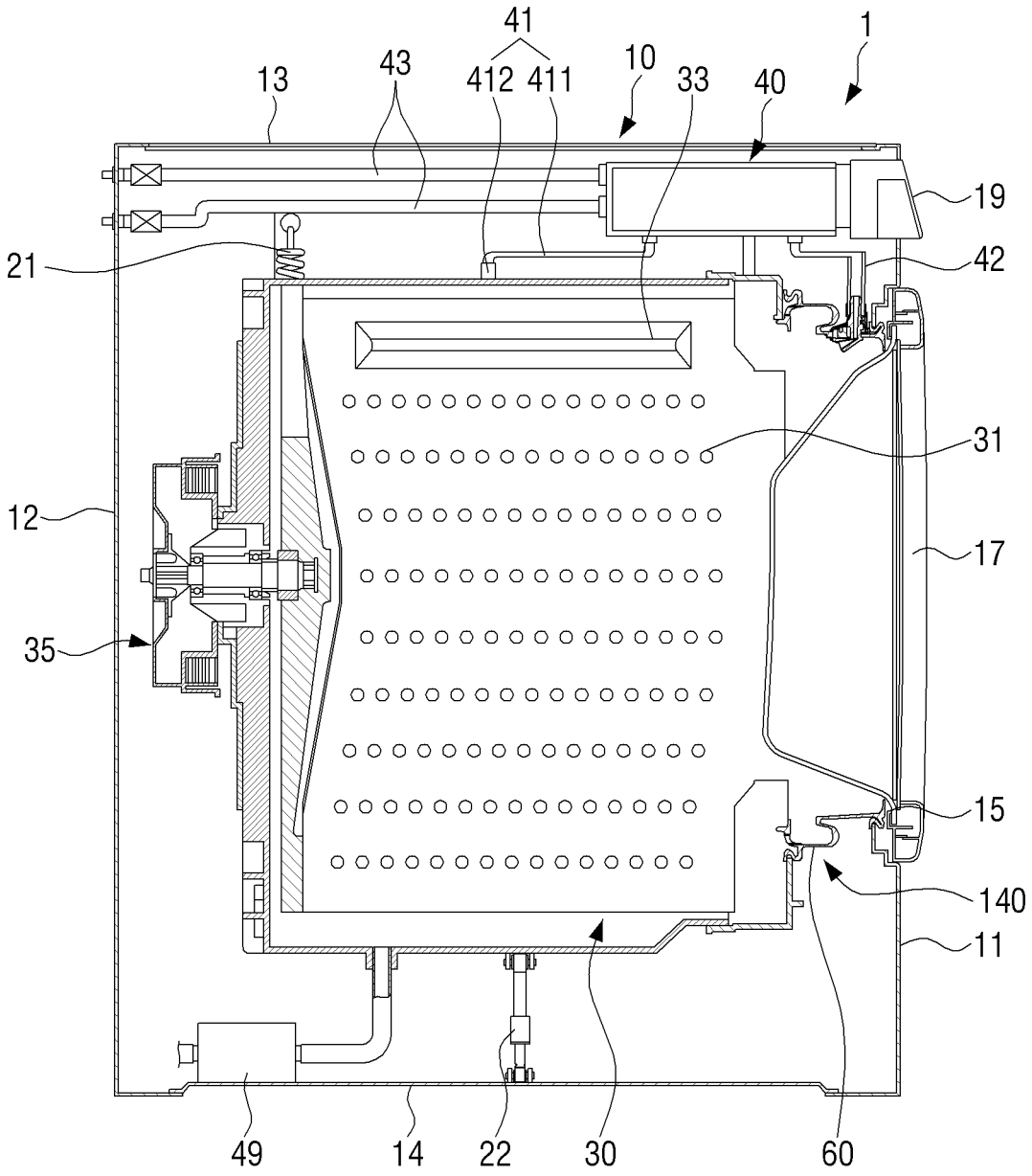
FIG. 3 is a cross-sectional view schematically illustrating a drum-type washing machine according to an embodiment of the disclosure.
Figure 4:
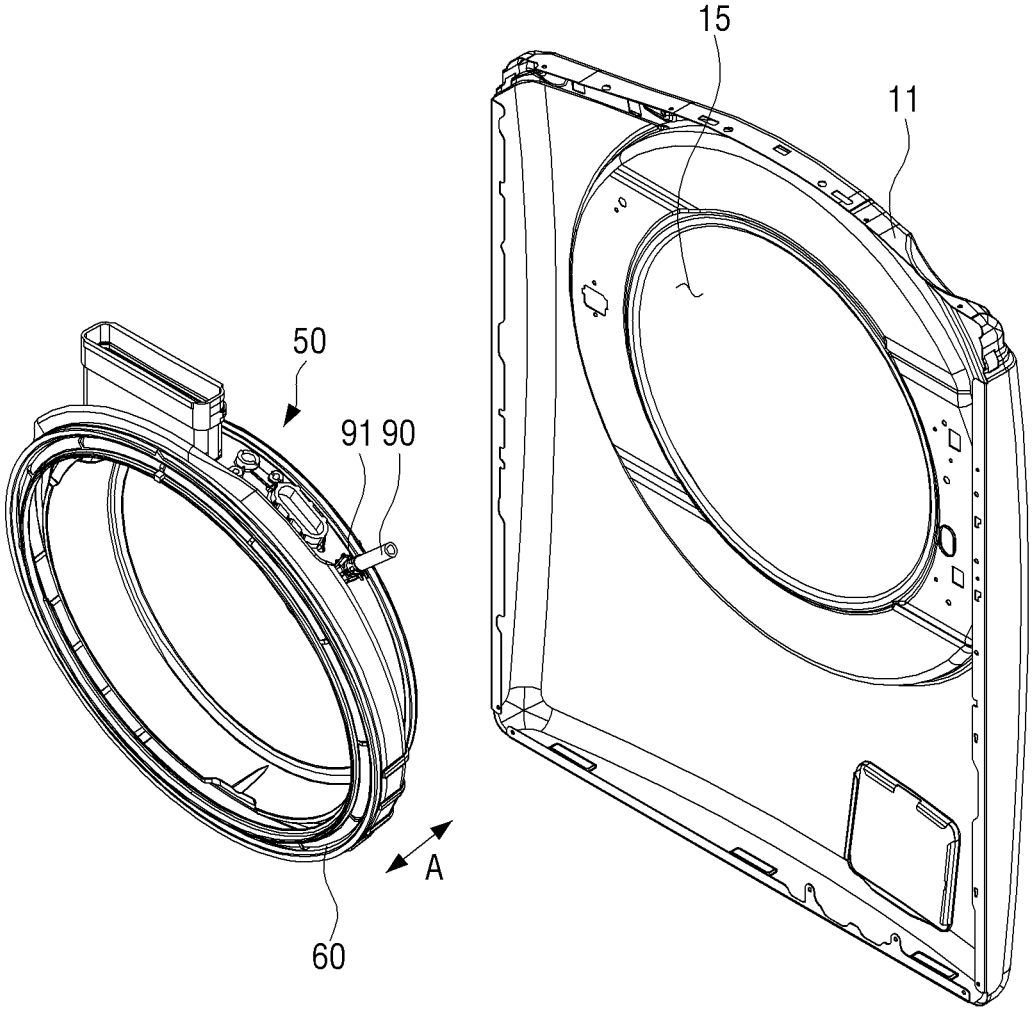
FIG. 4 is an exploded perspective view illustrating a front frame of a main body and a diaphragm assembly in a drum-type washing machine according to an embodiment of the disclosure.
Figure 5:
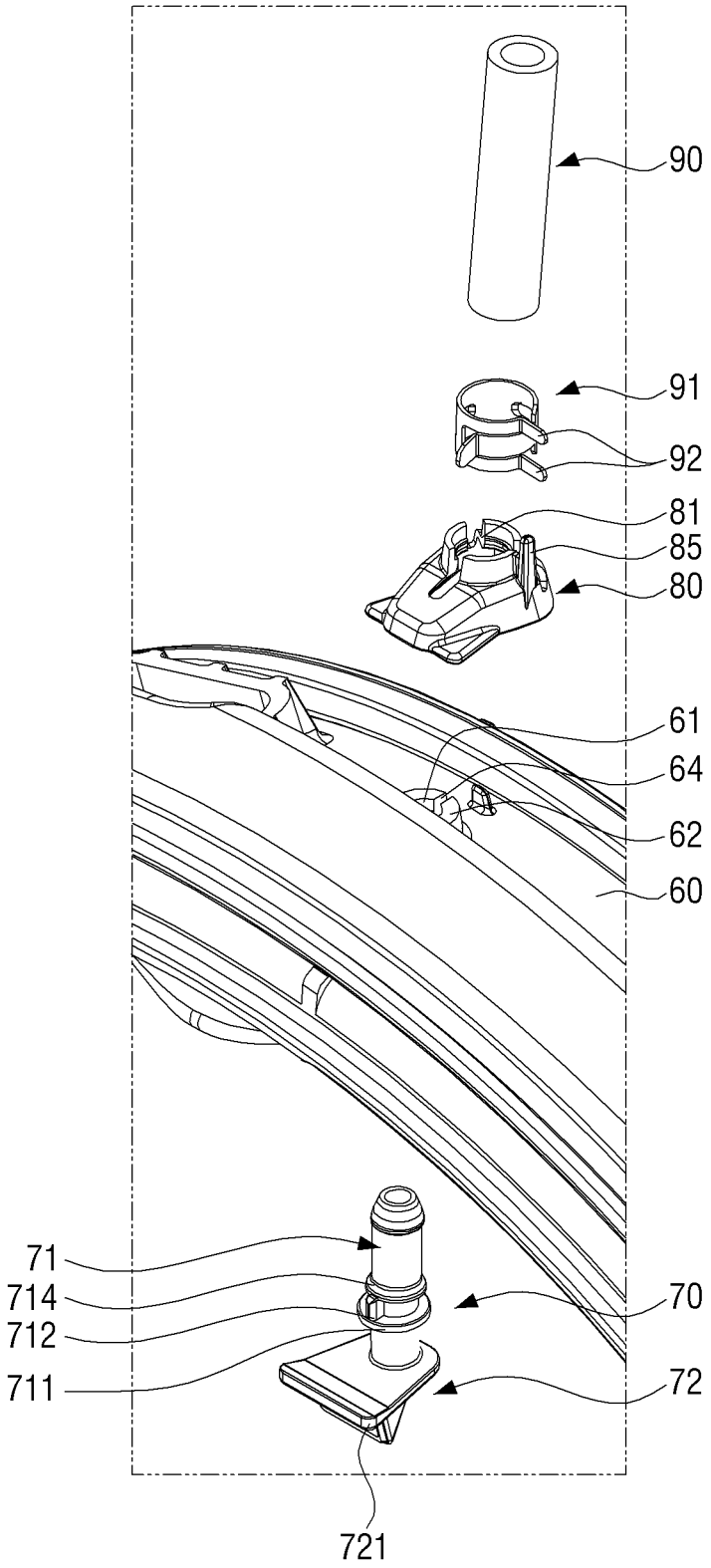
FIG. 5 is an exploded perspective view of a diaphragm assembly in a drum-type washing machine according to an embodiment of the disclosure.
Figure 6:
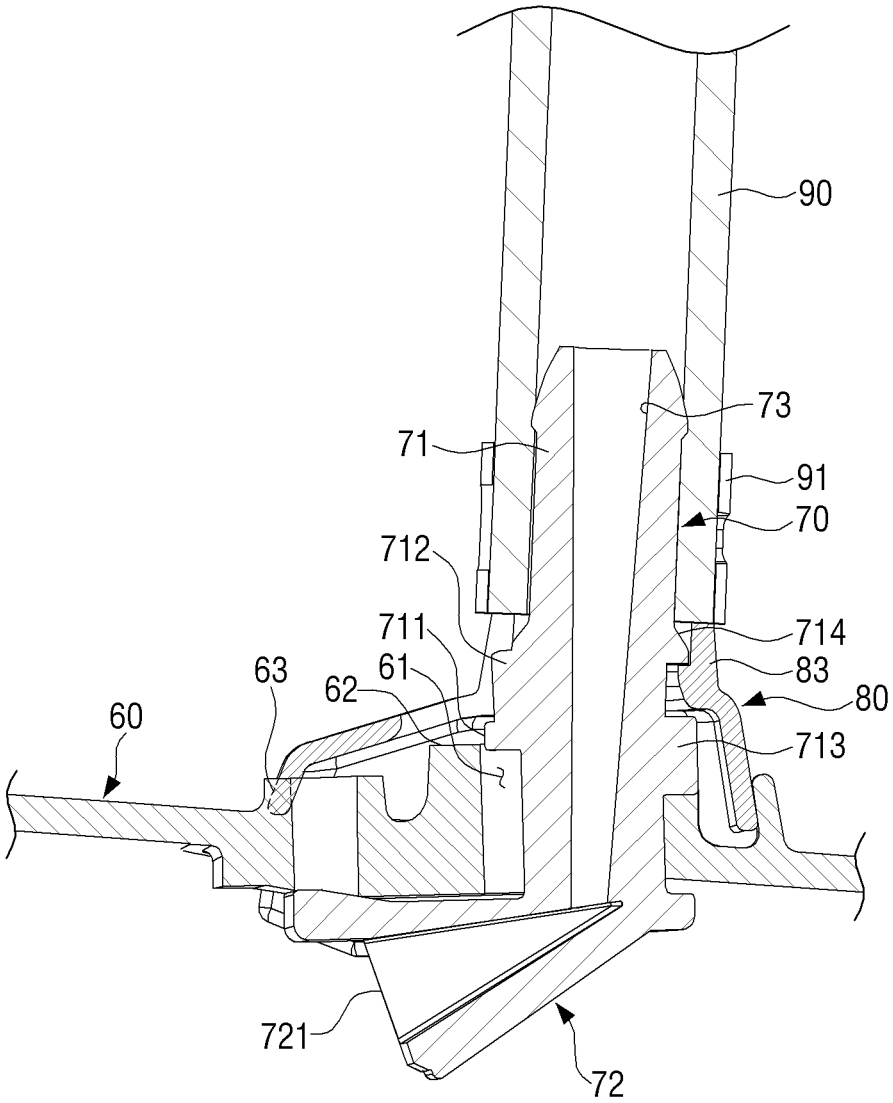
FIG. 6 is a partial cross-sectional view illustrating a coupling structure of a nozzle of a diaphragm assembly and a supply hose in a drum-type washing machine according to an embodiment of the disclosure.

FIG. 3 is a cross-sectional view schematically illustrating a drum-type washing machine according to an embodiment of the disclosure. FIG. 4 is an exploded perspective view illustrating a front frame of a main body and a diaphragm assembly in a drum-type washing machine according to an embodiment of the disclosure. FIG. 5 is an exploded perspective view of a diaphragm assembly in a drum-type washing machine according to an embodiment of the disclosure. FIG. 6 is a partial cross-sectional view illustrating a coupling structure of a nozzle of a diaphragm assembly and a supply hose in a drum-type washing machine according to an embodiment of the disclosure.

Referring to FIG. 3, the drum-type washing machine 1 according to an embodiment of the disclosure includes a main body 10, a tub 20, a drum 30, and a diaphragm assembly 50.

The main body 10 forms the appearance of the drum-type washing machine 1 and is formed in a substantially rectangular parallelepiped shape. The main body 10 may include a front frame 11, a rear frame 12, a left-side frame, a right-side frame, a top frame 13, and a bottom frame 14.

The front frame 11 of the main body 10 has a laundry inlet hole 15 provided for putting laundry into and out of the main body 10. A door 17 is installed in an openable/closable manner in the laundry inlet hole 15. A control panel 19 for controlling the washing machine may be provided at an upper portion of the front frame 11 of the main body 10.

The tub 20 is installed inside the main body 10 of the washing machine, and is formed in a cylindrical shape with an opening provided toward the laundry inlet hole 15 of the front frame 11. The tub 20 may store washing water required for washing. The tub 20 is supported and fixed to the main body 1 by a tension spring 21, an oil damper 22, and the like.

The drum 30 is rotatably installed inside the tub 20, and is formed in a substantially hollow cylindrical shape. The drum 30 has an opening corresponding to the laundry inlet hole 15 in the main body 10 of the washing machine and a plurality of communication holes 31 formed in a surface thereof. In addition, a plurality of lifts 33 are provided on an inner surface of the drum 30 to lift the laundry. The drum 30 may be rotated about a horizontal axis by a driving device including a drive motor 35 installed at a rear surface thereof.

A water supply device 40 is provided above the tub 20 to supply washing water to the tub 20, and a drainage device 49 is installed below the tub 20 to drain the washing water from the tub 20 to the outside.

The water supply device 40 is configured to supply the washing water to the tub 20 through two paths, that is, a first washing water supply path 41 and a second washing water supply path 42. The water supply device 40 is connected to a water supply pipe 43 protruding to an outer surface of the main body 10. Accordingly, when an external water supply source, for example water supply facilities, is connected to the water supply pipe 43 of the main body 10, the water supply device 40 may supply the washing water to the tub 20. The water supply device 40 may supply the washing water to the tub 20 through the first washing water supply path 41 and the second washing water supply path 42 according to the control on the control panel 19.

The first washing water supply path 41 is provided above the tub 20 to supply the washing water to the inside of the tub 20. Thus, an upper surface of the tub 20 is provided with a washing water supply pipe 412 to which one end of a first supply hose 411 for supplying the washing water is connected. The other end of the first supply hose 411 is connected to the water supply device 40.

The second washing water supply path 42 is provided to supply the washing water to the inside of the tub 20 through a diaphragm 60 installed at a front end of the tub 20. That is, the diaphragm assembly 50 forms the second washing water supply path 42.

Referring to FIG. 3, the diaphragm assembly 50 is installed between the tub 20 and the front frame 11 of the main body 10. Specifically, the diaphragm assembly 50 is installed between one end of the tub 20 having the opening corresponding to the laundry inlet hole 15 and the laundry inlet hole 15 of the front frame 11.

Referring to FIGS. 3 to 5, the diaphragm assembly 50 may include a diaphragm 60, a nozzle 70, a nozzle guide 80, a supply hose 90, and a fixing member 91.

The diaphragm 60 is installed between the tub 20 and the front frame 11 of the main body 10, and is formed in a substantially annular shape. One end of the diaphragm 60 is fixed to one end of the tub 20 having the opening, and the other end of the diaphragm 60 is fixed to an inner circumference of the laundry inlet hole 15 in the front frame 11 of the main body. The diaphragm 60 forms a passage through which the laundry passes, while preventing the washing water contained in the tub 20 from being leaked out of the tub 20. In addition, the diaphragm 60 prevents vibrations generated when the drum 30 is rotated from being transmitted to the front frame 11 of the main body 10 through the tub 20. The diaphragm 60 may be formed of rubber to prevent vibrations.

The diaphragm 60 has a nozzle hole 61 provided in a lateral surface thereof for the nozzle 70 to be inserted thereino.

The nozzle 70 is installed to penetrate through the lateral surface of the diaphragm 60. The nozzle 70 includes a connection portion 71 formed in a pipe shape to have a circular cross section, and a spraying portion 72 spraying the washing water toward the inside of the tub 20.

The connection portion 71 is inserted into the nozzle hole 61 of the diaphragm 60, and is formed to have a length to protrude out of the diaphragm 60. The connection portion 71 has a conical hole 73 formed inside. One end of the conical hole 73 connected to the supply hose 90 has a large diameter, and the other end of the conical hole 73 connected to the spraying portion 72 has a small diameter.

A fixing protrusion 62 having a predetermined height is provided on a circumference of the nozzle hole 61 provided in the diaphragm 60. That is, the nozzle hole 61 is formed inside the fixing protrusion 62 provided at the lateral surface of the diaphragm 60. The fixing protrusion 62 is formed to have a smaller height than the nozzle guide 80. In addition, a sub fixing protrusion 63 may be provided at one side of the fixing protrusion 62, that is, in a longitudinal direction (arrow A) of the diaphragm 60. The sub fixing protrusion 63 prevents the nozzle guide 80 from rotating relative to the diaphragm 60. Accordingly, the nozzle guide 80 may be installed at a predetermined position of the diaphragm 60 by the fixing protrusion 62 and the sub fixing protrusion 63.

A blocking ring 711 blocking a through-hole of the nozzle guide 80 is provided around a part of the connection portion 71 adjacent to the spraying portion 72. The blocking ring 711 may be formed to protrude perpendicularly from an outer circumferential surface of the connection portion 71. For example, the blocking ring 711 may be formed as a circular cross-sectional protrusion protruding along the outer circumferential surface of the connection portion 71. Thus, the blocking ring 711 has a diameter larger than an outer diameter of the connection portion 71. In addition, the blocking ring 711 is provided to be positioned above the fixing protrusion 62, when the nozzle 70 is inserted into the nozzle hole 61 of the diaphragm 60.

A first fixing wing 712 may be provided at one side of the blocking ring 711 in a direction in which the supply hose 90 is connected. The first fixing wing 712 may be formed as a protrusion protruding in the same direction as the spraying portion 72. The first fixing wing 712 is inserted into a fixing groove of the nozzle guide 80 to determine a washing water discharging direction of the nozzle 70.

A second fixing wing 713 is provided at one side of the blocking ring 711 facing the spraying portion 72, that is, on the opposite side of one side of the blocking ring 711 at which the first fixing wing 712 is provided. The second fixing wing 713 is installed to be spaced 180 degrees apart from the first fixing wing 712. The second fixing wing 713 is inserted into a reference groove 64 provided in the fixing protrusion 62 of the diaphragm 60. The reference groove 64 in the fixing protrusion 62 is formed in the longitudinal direction (arrow A) of the diaphragm 60. Thus, when the second fixing wing 713 is inserted into the reference groove 64, the washing water discharging direction of the spraying portion 62 is determined to be the longitudinal direction of the diaphragm 60.

In addition, a stopper 714 is provided above the first fixing wing 712, that is, around one end of the connection portion 71 to which the supply hose 90 is coupled, to restrict the insertion into the supply hose 90. The stopper 714 may be formed to protrude perpendicularly from the outer circumferential surface of the connection portion 71. For example, the stopper 714 may be formed as a circular cross-sectional protrusion protruding along the outer circumferential surface of the connection portion 71. Accordingly, the stopper 714 is formed in a shape similar to that of the blocking ring 711. The stopper 714 is formed to have a diameter larger than the outer diameter of the connection portion 71 and smaller than an outer diameter of the blocking ring 711.

The spraying portion 72 is installed to extend at a predetermined angle with respect to the connection portion 71, and is located at an inner side of the diaphragm 60 to discharge the washing water toward the tub 20 at a predetermined pressure. In the embodiment, an upper surface of the spraying portion 72 extends to be substantially perpendicular to the connection portion 71.

The spraying portion 72 is formed as a substantially fan-shaped duct, and an outlet 721 of the spraying portion 72 is formed in a rectangular shape having a cross section of which a width is larger than a height. Further, the spraying portion 72 has a cross section in a substantially triangular shape when cut perpendicularly with respect to the outlet 721. Thus, the outlet 721 of the spraying portion 72 forms one side of the triangle, and an outlet of the conical hole 73 in the connection portion 71 forms a vertex facing one side 721 of the triangle. Therefore, the duct having a triangular cross section for the spraying portion 72 and the conical hole 73 of the connection portion 71 form a water channel through which the washing water passes. In addition, the outlet of the spraying portion 72 is disposed such that its center line is in alignment with the first fixing wing 712 and the second fixing wing 713 of the connection portion 71.

The nozzle guide 80 is installed at an outer surface of the diaphragm 60, and supports or fixes the nozzle 70 to the diaphragm 60. In addition, the nozzle guide 80 functions to restrict an installation position of the fixing member 91 fixing the supply hose 90 to one end of the nozzle 70. The nozzle guide 80 is formed in a substantially rectangular parallelepiped shape, and a through-hole 81 through which the connection portion 71 of the nozzle 70 may be inserted is formed to penetrate an upper surface and a lower surface of the nozzle guide 80. In addition, the lower surface of the nozzle guide 80 has a space provided for accommodating the fixing protrusion 62 and the sub fixing protrusion 63 of the diaphragm 60. The through-hole 81 of the nozzle guide 80 has a fixing groove 84 provided for coupling the first fixing wing 712 of the nozzle 70. The nozzle guide 80 will be described in detail later.

The supply hose 90, which is for supplying the washing water into the tub 20, is connected to one end of the nozzle 70 protruding through the through-hole 81 of the nozzle guide 80. The other end of the supply hose 90 is connected to the water supply device 40 described above.

The supply hose 90 is fixed to one end of the nozzle 70 by the fixing member 91. Specifically, as illustrated in FIG. 6, when the connection portion 71 of the nozzle 70 protruding above an upper surface of the nozzle guide 80 is inserted into one end of the supply hose 90, the supply hose 90 is fixed to one end portion of the nozzle 70 by the fixing member 91 installed at one end of the supply hose 90.

A method of fixing one end of the supply hose 90 to the connection portion 71 of the nozzle 70 by the fixing member 91 will be described in detail with reference to FIG. 6.

When the connection portion 71 of the nozzle 70 is inserted into the nozzle hole 61 from the inner side of the diaphragm 60, the upper surface of the spraying portion 72 of the nozzle 70 is in contact with an inner surface of the diaphragm 60, and one end of the nozzle 70 protrudes above the outer side of the diaphragm 60. In this state, if the connection portion 71 of the nozzle 70 protruding above the outer side of the diaphragm 60 is inserted into the through-hole 81 of the nozzle guide 80, one end of the nozzle 70 protrudes above the upper surface of the nozzle guide 80. Subsequently, the connection portion 71 of the nozzle 70 protruding above the nozzle guide 80 is inserted into one end of the supply hose 90.

Before connecting the supply hose 90 to the nozzle 70, the fixing member 91 is coupled to one end of the supply hose 90 on an outer circumferential surface thereof. For the fixing member 91, a hose clamp may be used. In the embodiment, a one-touch hose clamp 91 is used so that the hose clamp may be operated with one touch. As illustrated in FIG. 5, the one-touch hose clamp 91 is formed by bending a thin elastic band in a cylindrical shape, with a pair of push portions 92 provided at both ends thereof. When the pair of push portions 92 are pushed, a diameter of the one-touch hose clamp 91 increases, so that one end of the supply hose 90 may be inserted into the one-touch hose clamp 91. When the force applied to the pair of push portions 92 is removed, the one-touch hose clamp 91 is returned to its original diameter by the elastic force so that the one-touch hose clamp 91 may be fixed to the supply hose 90.

Thus, an operator inserts the connection portion 71 of the nozzle 70 protruding above the nozzle guide 80 into the supply hose 90, in a state in which the push portions 92 of the one-touch hose clamp 91 are pushed to increase the diameter of the one-touch hose clamp 91. Once one end of the supply hose 90 is adjacent to the stopper 714 of the connection portion 71 of the nozzle 70, the operator removes the force that pushes the push portions 92 of the one-touch hose clamp 91. Then, a compressive force is applied to the supply hose 90 by the one-touch hose clamp 91 so that the supply hose 90 may be fixed to the connection portion 71 of the nozzle 70.

At this time, the push portions 92 of the one-touch hose clamp 91 interfere with a rib 85 of the nozzle guide 80. Thus, the operator locates the push portions 92 of the one-touch hose clamp 91 far away from the front frame 11 of the main body 10 and toward the tub 20 so as not to interfere with the rib 85 of the nozzle guide 80.

In the embodiment, it is described that the one-touch hose clamp is used as the fixing member 91. However, the fixing member 91 for fixing the supply hose 90 to one end of the nozzle 70 is not limited thereto. For the fixing member 91, various fixing means capable of fixing the supply hose 90 to the nozzle 70 may be used, as well as the one-touch hose clamp. Also, the disclosure may be applied when a protruding portion of the fixing means is possibly in contact with the front frame 11 of the main body 10.

Hereinafter, a nozzle guide for use in a diaphragm assembly according to an embodiment of the disclosure will be described in detail with reference to the accompanying drawings.

Figure 7A:
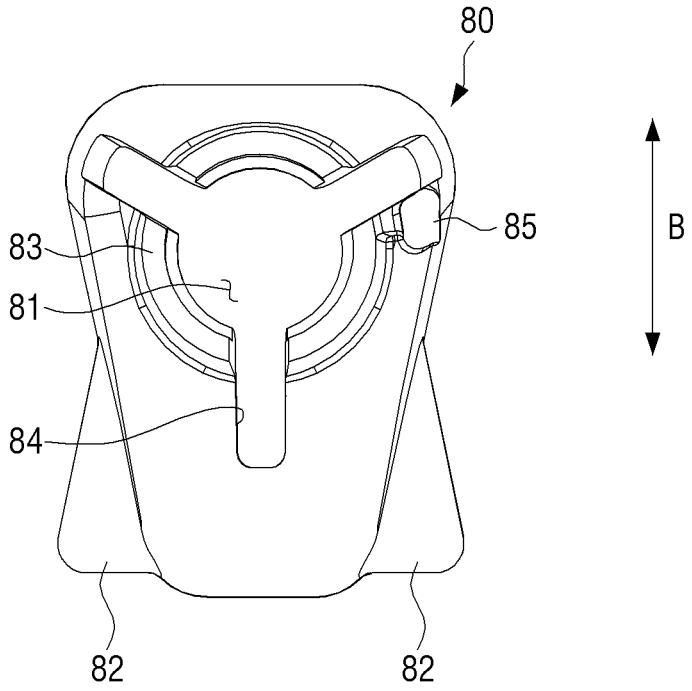
FIG. 7A is a plan view of a nozzle guide of a diaphragm assembly in a drum-type washing machine according to an embodiment of the disclosure.
Figure 7B:
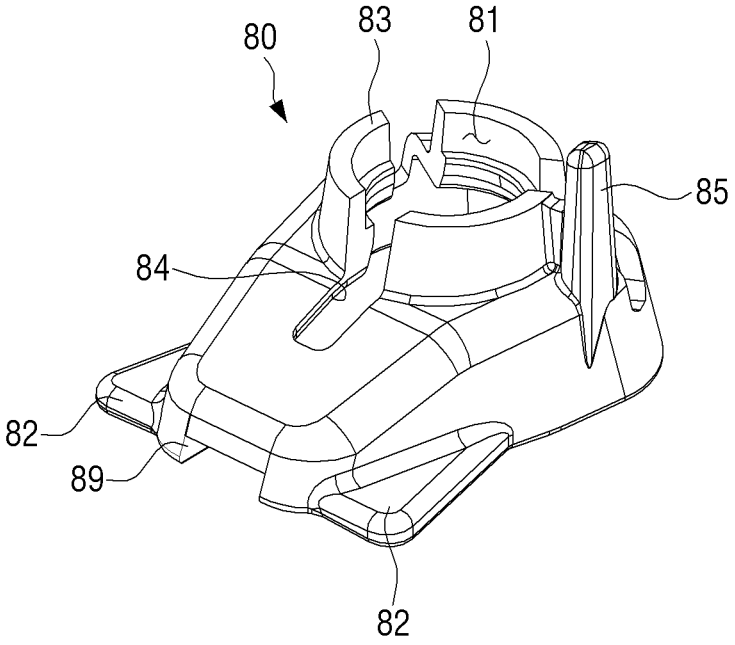
FIG. 7B is a perspective view of the nozzle guide of FIG. 7A.
Figure 7C:
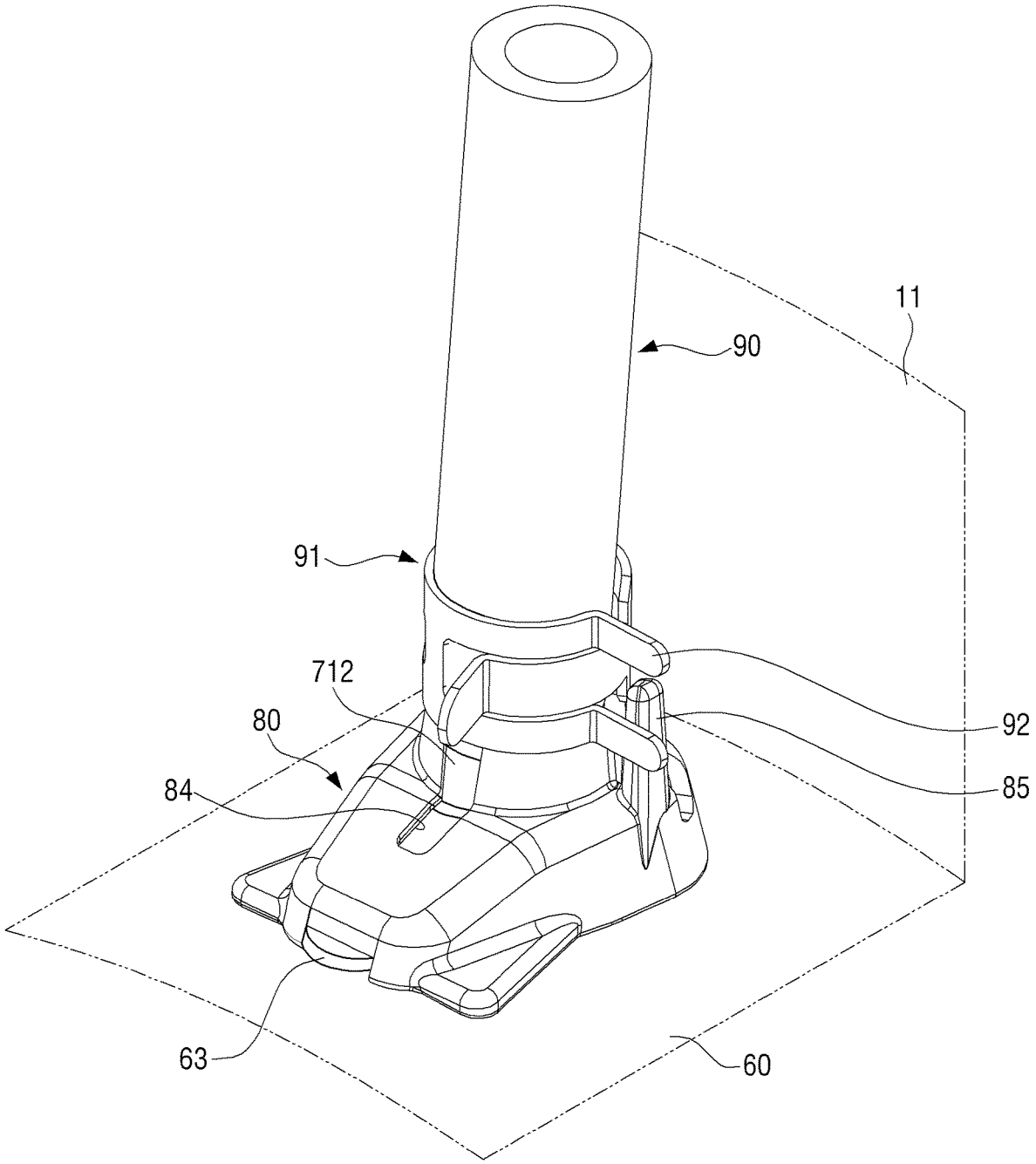
FIG. 7C is a partial perspective view illustrating a relationship between the nozzle guide of FIG. 7A and a hose clamp.

FIGS. 7A to 7C illustrate an example of a nozzle guide for use in a diaphragm assembly according to an embodiment of the disclosure.

FIG. 7A is a plan view of a nozzle guide of a diaphragm assembly in a drum-type washing machine according to an embodiment of the disclosure, and FIG. 7B is a perspective view of the nozzle guide of FIG. 7A. FIG. 7C is a partial perspective view illustrating a relationship between the nozzle guide of FIG. 7A and a hose clamp.

Referring to FIGS. 7A and 7B, the nozzle guide 80 is formed in a substantially rectangular parallelepiped shape, with a lower surface thereof being open. That is, the nozzle guide 80 is formed in the shape of a container having a substantially rectangular cross section. The nozzle guide 80 has a pair of feet 82 each provided on the same plane as the lower surface in the periphery of one end on each of the both sides. In addition, the nozzle guide 80 has a through-hole 81 provided in the upper surface thereof for the connection portion 71 of the nozzle 70 to be inserted thereinto. The nozzle guide 80 has an annular protrusion 83 provided on a circumference of the through-hole 81 to function as a stopper while supporting the supply hose 90 and the fixing member 91. Therefore, the annular protrusion 83 is formed to have a diameter larger than an outer diameter of the supply hose 90.

The upper surface of the nozzle guide 80 and the annular protrusion 83 have a fixing groove 84 provided for the first fixing wing 712 of the connection portion 71 of the nozzle 70 to be inserted thereinto. The fixing groove 84 of the nozzle guide 80 is formed in a radial direction from the through-hole 81. Once the first fixing wing 712 of the nozzle 70 is inserted into the fixing groove 84 of the nozzle guide 80, the nozzle 70 cannot rotate relative to the diaphragm 60, thereby fixing a direction in which the washing water is discharged from the spraying portion 72 of the nozzle 70. The nozzle guide 80 may have only one fixing groove 84, but three fixing grooves 84 are provided in the nozzle guide 80 at intervals of about 120 degrees in the embodiment illustrated in FIGS. 7A and 7B.

A side groove 89 may be provided in a lateral surface of the nozzle guide 80. The side groove 89 is formed at a predetermined depth from the lower surface of the nozzle guide 80. That is, the side groove 89 of the nozzle guide 80 is provided in a substantially rectangular shape at a lower end of the lateral surface of the nozzle guide 80. When the nozzle guide 80 is installed at the outer surface of the diaphragm 60, the sub fixing protrusion 63 of the diaphragm 60 is partially exposed through the side groove 89 of the nozzle guide 80.

In addition, the nozzle guide 80 may include a rib 85 restricting an installation position of a protrusion 92 of the fixing member 91 fixing the supply hose 90, which is coupled to one end of the nozzle 70, to the nozzle 70.

For example, when the nozzle guide 80 is installed at the outer surface of the diaphragm 60 as illustrated in FIG. 7C, the push portions 92 of the one-touch hose clamp 91 fixing the supply hose 90 interfere with the rib 85 of the nozzle guide 80, so that the push portions 92 of the hose clamp 91 are not installed at a position where the push portions 92 of the hose clamp 91 are possibly in contact with the front frame 11 of the main body 10. That is, the rib 85 of the nozzle guide 80 functions to prevent the push portions 92 of the hose clamp 91 from being in contact with the front frame 11 of the main body 10.

Here, the one-touch hose clamp 91 is a fixing member fixing the supply hose 90 to the connection portion 71 of the nozzle 70 to prevent the connection portion 71 of the nozzle 70 from being released from the supply hose 90, and the push portions 92 of the one-touch hose clamp 91 correspond to the protrusion of the fixing member. Therefore, the rib 85 of the nozzle guide 80 may prevent the protrusion 92 of the fixing member 91 from being in contact with the front frame 11 of the main body 10.

To this end, the rib 85 of the nozzle guide 80 extends upwardly from the upper surface of the nozzle guide 80, and is formed at a height to interfere with the protrusion 92 of the fixing member 91. For example, the rib 85 may be formed to have an upper end positioned at a middle height of the protrusion 92 of the fixing member 91. When the one-touch hose clamp is used as the fixing member 91, the rib 85 may be formed to have an upper end positioned at a middle height of the push portion 92 of the one-touch hose clamp 91. That is, the rib 85 may be formed such that the upper end thereof is positioned at a height corresponding to one half of a width of the one-touch hose clamp 91.

The rib 85 may be provided at various positions on the upper surface of the nozzle guide 80 as long as the protrusion 92 of the fixing member 91 is prevented from being installed at a position in contact with or adjacent to the front frame 11 of the main body 10.

As an example, the rib 85 may be provided on the upper surface of the nozzle guide 80 next to one side of the through-hole 81. For example, as illustrated in FIG. 7C, the rib 85 may be formed in the bar shape on the nozzle guide 80 next to one side of the supply hose 90 to face the front frame 11 of the main body 10 together with the supply hose 90. Thus, when the nozzle guide 80 is installed to be substantially perpendicular to the front frame 11 of the main body 10 in the longitudinal direction, the rib 85 is provided such that a line which the through-hole 81 and the rib 85 form is substantially parallel to the front frame 11. In addition, when the supply hose 90 is coupled to the nozzle 70 inserted into the through-hole 81 of the nozzle guide 80, the supply hose 90 and the rib 85 are installed side by side to face the front frame 11 of the main body 10. Thus, the rib 85 is not positioned between the supply hose 90 and the front frame 11.

As illustrated in FIGS. 7B and 7C, the rib 85 is formed in the bar shape. However, the shape of the rib 85 is not limited thereto. The rib 85 may be formed in various forms, as long as the rib 85 is capable of preventing the protrusion 92 of the fixing member 91 from being in contact with the front frame 11 so as not to interfere with the front frame 11.

In FIGS. 7B and 7C, it is illustrated that the rib 85 is provided at one side of the through-hole 81 of the nozzle guide 80. However, the rib 85 may be provided in pair at both sides of the through-hole 81 of the nozzle guide 80.

Figure 8:
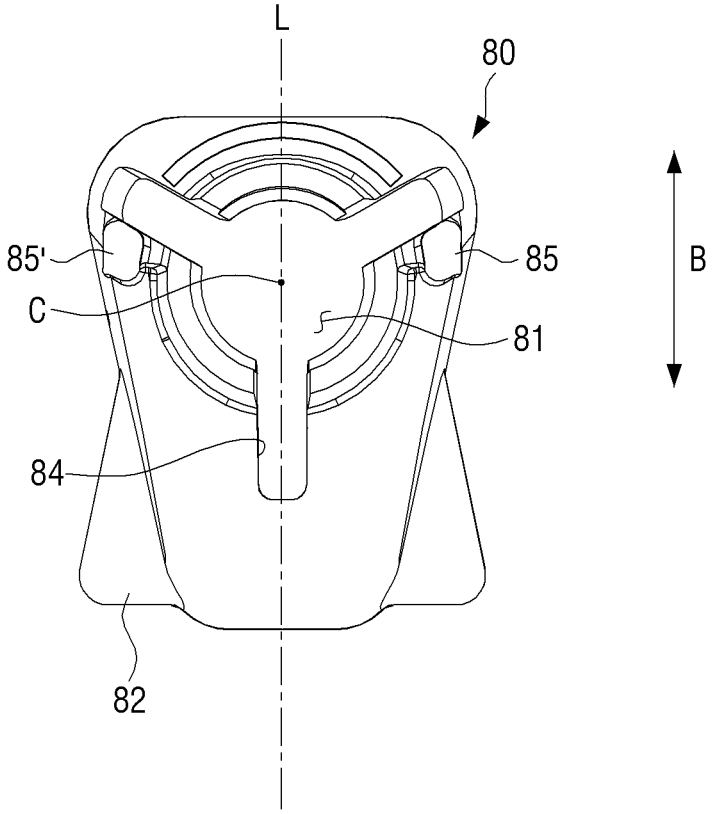
FIG. 8 is a plan view of a nozzle guide according to another embodiment of the disclosure.

In FIG. 8, it is illustrated that the nozzle guide 80 includes a pair of ribs 85.

FIG. 8 is a plan view of a nozzle guide according to another embodiment of the disclosure.

Referring to FIG. 8, a pair of ribs 85 and 85' are installed at both sides of the through-hole 81 of the nozzle guide 80. That is, the pair of ribs 85 and 85' and the through-hole 81 positioned therebetween are installed side by side while facing the front frame 11 of the main body 10. A first rib 85 of the pair of ribs 85 and 85' may be formed at the same position as that illustrated in FIGS. 7A and 7B. A second rib 85' is formed on the upper surface of the nozzle guide 80 to be linearly symmetrical with the first rib 85 with respect to a straight line L passing through the center C of the through-hole 81 of the nozzle guide 80 in the longitudinal direction (arrow B) of the nozzle guide 80. Accordingly, the pair of ribs 85 and 85' are arranged to be linearly symmetrical with each other with respect to the straight line L passing through the center C of the through-hole 81 of the nozzle guide 80 in the longitudinal direction (arrow B) of the nozzle guide 80.

The nozzle guide 80 is formed at an outer circumferential surface of the diaphragm 60 such that the straight line L passing through the center C of the through-hole 81 of the nozzle guide 80 is substantially perpendicular to the front frame 11 of the main body 10. Accordingly, the pair of ribs 85 and 85' may be arranged to be linearly symmetrical with each other with respect to the straight line L passing through the center C of the through-hole 81 of the nozzle guide 80 while being substantially perpendicular to the front frame 11 of the main body 10.

It is described above that the rib 85 of the nozzle guide 80 is formed to function to restrict or guide the position of the protrusion 92 of the fixing member 91. As another example, however, the rib may be formed to prevent the protrusion 92 of the fixing member 91 from being placed at a predetermined position of the nozzle guide 80.

Hereinafter, a nozzle guide including such a rib will be described with reference to FIGS. 9A to 9C.

Figure 9A:
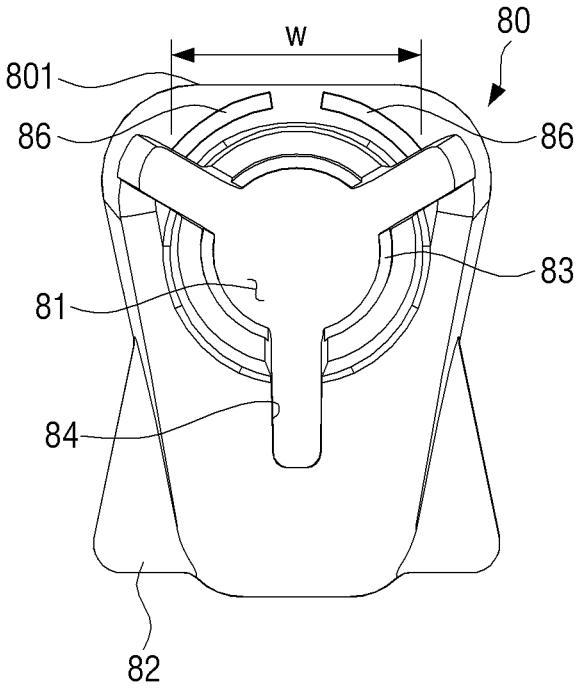
FIG. 9A is a plan view of a nozzle guide of a diaphragm assembly in a drum-type washing machine according to another embodiment of the disclosure.

FIG. 9A is a plan view of a nozzle guide of a diaphragm assembly in a drum-type washing machine according to another embodiment of the disclosure. FIG. 9B is a perspective view of the nozzle guide of FIG. 9A, and FIG. 9C is a partial perspective view illustrating a relationship between the nozzle guide of FIG. 9A and a hose clamp.

Figure 9B:
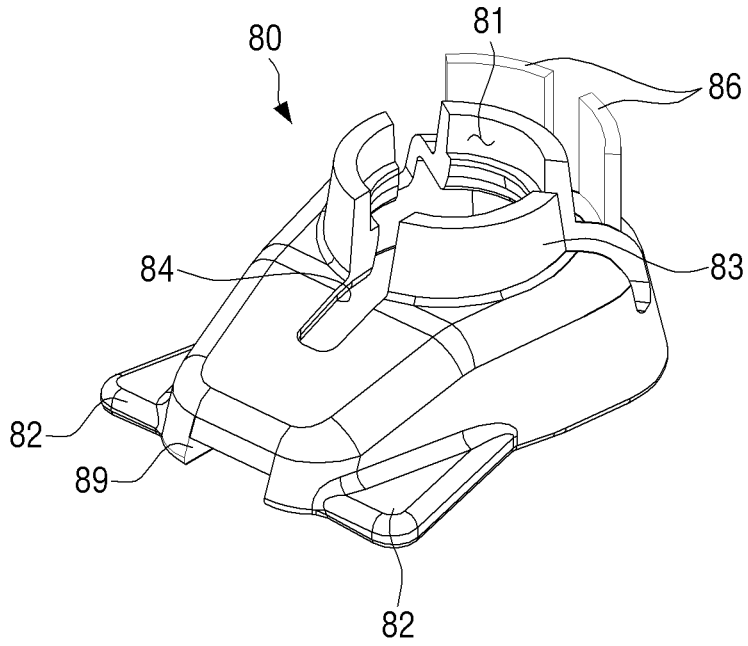
FIG. 9B is a perspective view of the nozzle guide of FIG. 9A.
Figure 9C:
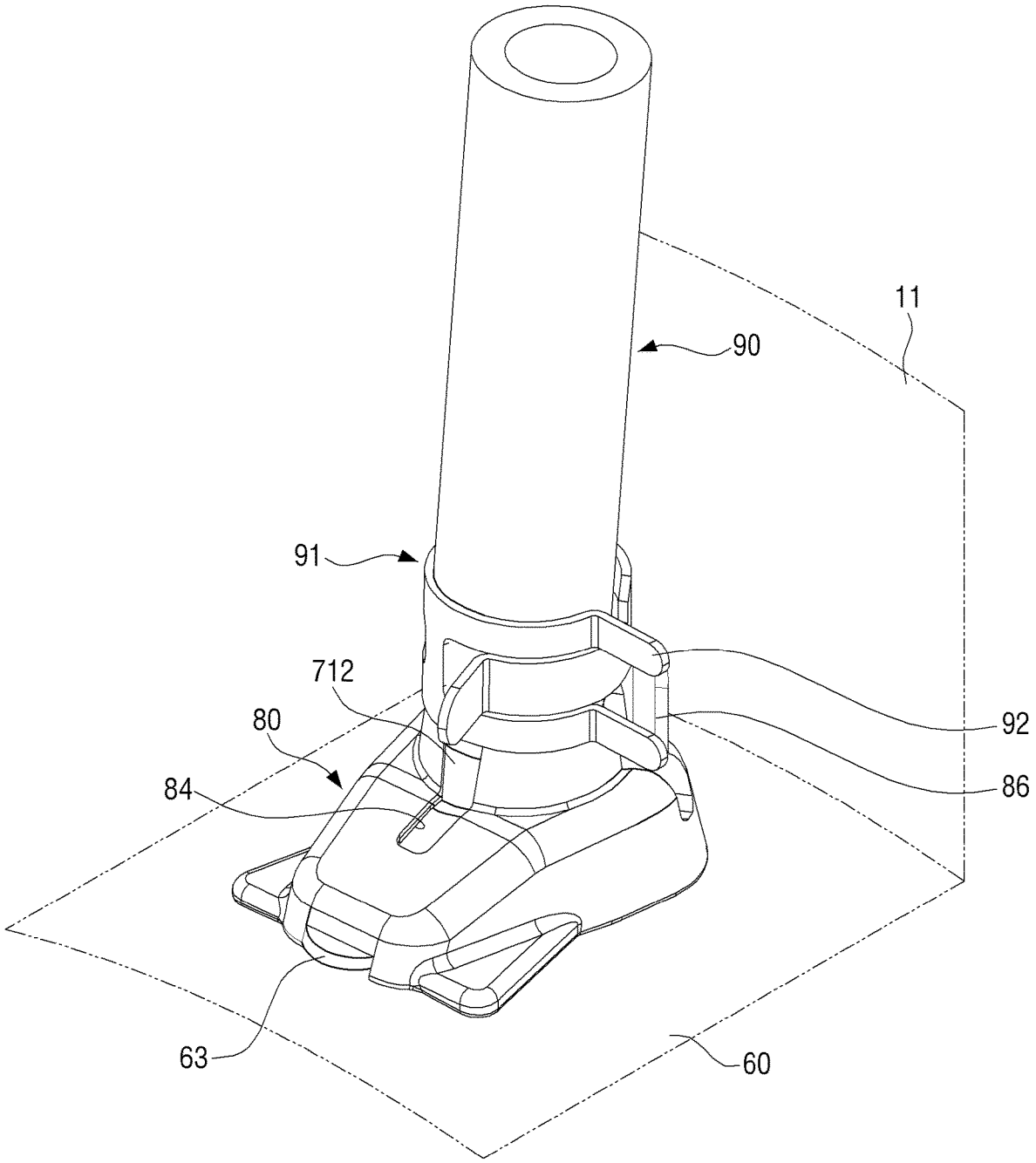
FIG. 9C is a partial perspective view illustrating a relationship between the nozzle guide in FIG. 9A and a hose clamp.

The nozzle guide 80 according to the embodiment illustrated in FIGS. 9A to 9C is the same as that according to the embodiment illustrated in FIGS. 7A to 7C, except the rib 86. Thus, the rib 86 will only be described below.

The rib 86 is formed to protrude upwardly from the upper surface of the nozzle guide 80 at a front side thereof adjacent to the front frame 11 of the main body 10. Thus, the rib 86 is positioned between the through-hole 81 of the nozzle guide 80 and the front frame 11. When the supply hose 90 is coupled to one end of the nozzle 70 protruding out of the through-hole 81 of the nozzle guide 80 as illustrated in FIG. 9C, the rib 86 is formed to be positioned between the supply hose 90 and the front frame 11 of the main body 10.

The rib 86 may be formed of a plurality of barrier walls arranged along a curved line having an identical or similar curvature to the supply hose 90 or the through-hole 81 of the nozzle guide 80. FIGS. 9A to 9C illustrate the embodiment where the rib 86 is formed of two barrier walls.

Each of the plurality of barrier walls 86 is formed as a curved surface having an identical or similar curvature to the supply hose 90 or the through-hole 81 of the nozzle guide 80. In addition, a width W of the rib 86, that is, a distance between the outermost ends of the plurality of barrier walls 86 is determined based on a position at which the protrusion 92 of the fixing member 91 is possibly in contact with the front frame 11 of the main body 10 when the protrusion 92 of the fixing member 91 of the supply hose 90 is placed or the protrusion 92 of the fixing member 91 is possibly in contact with the front frame 11 when the diaphragm 60 vibrates during washing. For example, the width W of the rib 86 may be determined to be no greater than a width of a front surface 801 of the nozzle guide (one surface of the nozzle guide 80 facing the front frame 11).

Thus, the rib 92 is provided at a portion of the nozzle guide 80 where the protrusion 92 of the fixing member 91 is possibly in contact with the front frame 11 when positioned in place. When the operator fixes the supply hose 90 by means of the fixing member 91, the protrusion 92 of the fixing member 91 cannot be placed at a position that possibly causes the protrusion 92 of the fixing member 91 to be in contact with the front frame 11 of the main body 10. Therefore, the rib 86 of the nozzle guide 80 may prevent the protrusion 92 of the fixing member 91 from being in contact with the front frame 11 of the main body 10.

Figure 10:
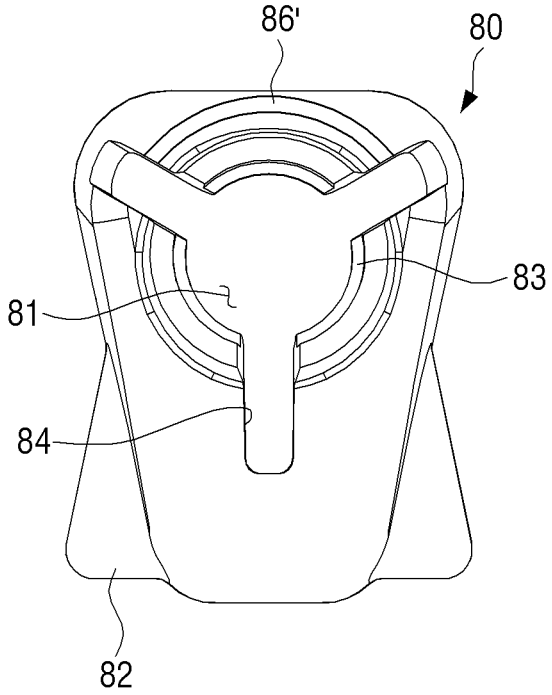
FIG. 10 is a plan view of a nozzle guide according to another embodiment of the disclosure.

It is described above that the rib 86 of the nozzle guide 80 is formed of a plurality of barrier walls, but the plurality of barrier walls 86 may be replaced with one barrier wall as illustrated in FIG. 10.

The nozzle guide 80 illustrated in FIG. 10 is the same as that according to the embodiment illustrated in FIGS. 9A to 9C, except that the rib 86' is formed of one barrier wall having an identical or similar curvature to the supply hose 90 or the through-hole 81 of the nozzle guide 80 on the upper surface of the nozzle guide 80 at the front side thereof, that is, at a portion to face the front frame 11. That is, the nozzle guide 80 in FIG. 10 is formed to have one barrier wall 86' instead of the plurality of barrier walls 86 of the nozzle guide 80 in FIGS. 9A to 9C.

The barrier wall forming the rib 86 or 86' as illustrated in FIGS. 9A to 10 is formed in the shape of a curved plate having a constant thickness. As another example, however, the barrier wall may be formed as an inclined wall as illustrated in FIG. 11.

Figure 11:
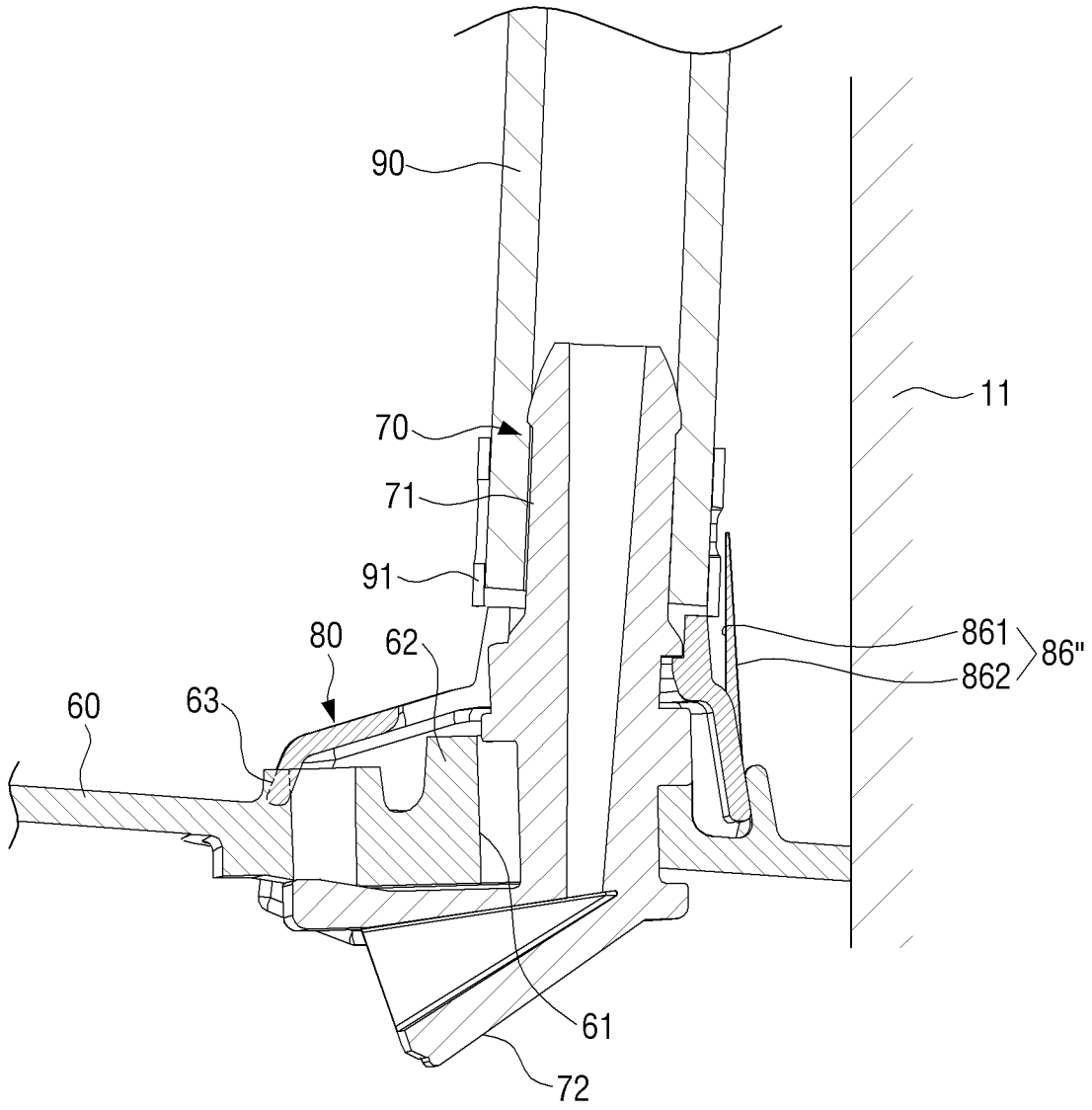
FIG. 11 is a cross-sectional view illustrating an example of a barrier wall of a nozzle guide according to another embodiment of the disclosure.

FIG. 11 is a cross-sectional view illustrating an example of a barrier wall of a nozzle guide according to another embodiment of the disclosure.

Referring to FIG. 11, the barrier wall forming the rib 86" has an inner surface 861 facing the supply hose 90 and an outer surface 862 facing the front frame 11 of the main body 10. The inner surface 861 is substantially perpendicular to the lower surface of the nozzle guide 80, and the outer surface 862 is formed as an inclined surface that is inclined downwardly toward the lower surface of the nozzle guide 80. The rib 86" formed to have an inclined surface, which makes a space between an upper end of the rib 86" and the front frame 11 maximal, may be applied even when a space between the nozzle guide 80 and the front frame 11 of the main body 10 is very narrow.

Hereinafter, another example of a nozzle guide of a diaphragm assembly in a drum-type washing machine according to an embodiment of the disclosure will be described with reference to FIGS. 12A to 12C.

Figure 12A:
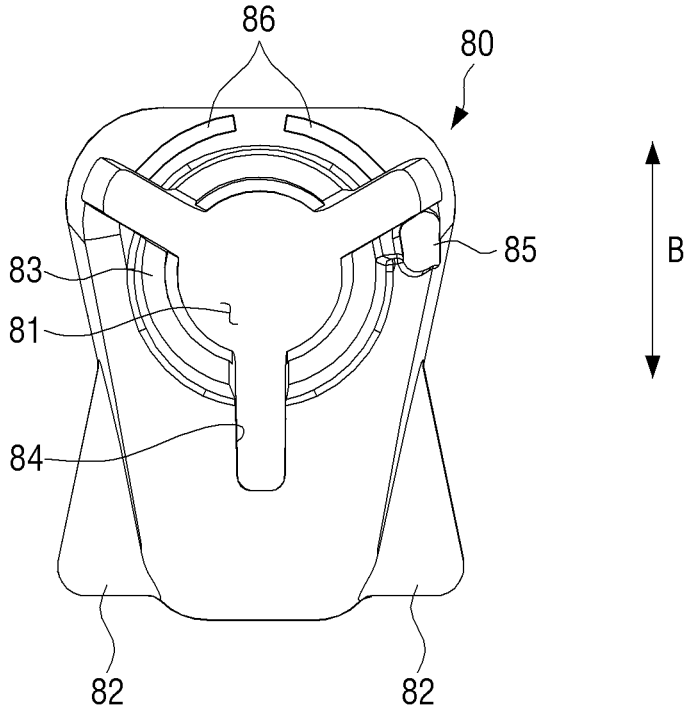
FIG. 12A is a plan view of a nozzle guide of a diaphragm assembly in a drum-type washing machine according to another embodiment of the disclosure.

FIG. 12A is a plan view of a nozzle guide of a diaphragm assembly in a drum-type washing machine according to another embodiment of the disclosure. FIG. 12B is a perspective view of the nozzle guide of FIG. 12A, and FIG. 12C is a partial perspective view illustrating a relationship between the nozzle guide of FIG. 12A and a hose clamp.

Figure 12B:
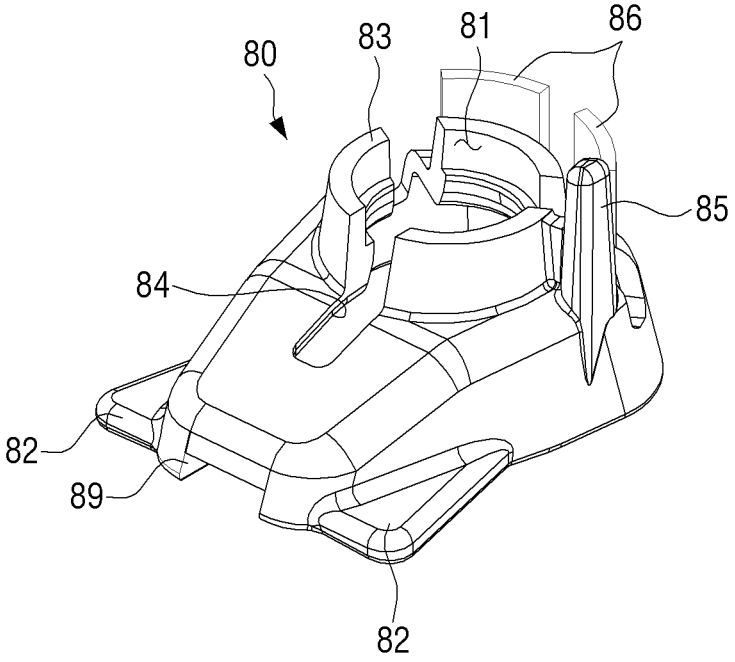
FIG. 12B is a perspective view of the nozzle guide of FIG. 12A.
Figure 12C:
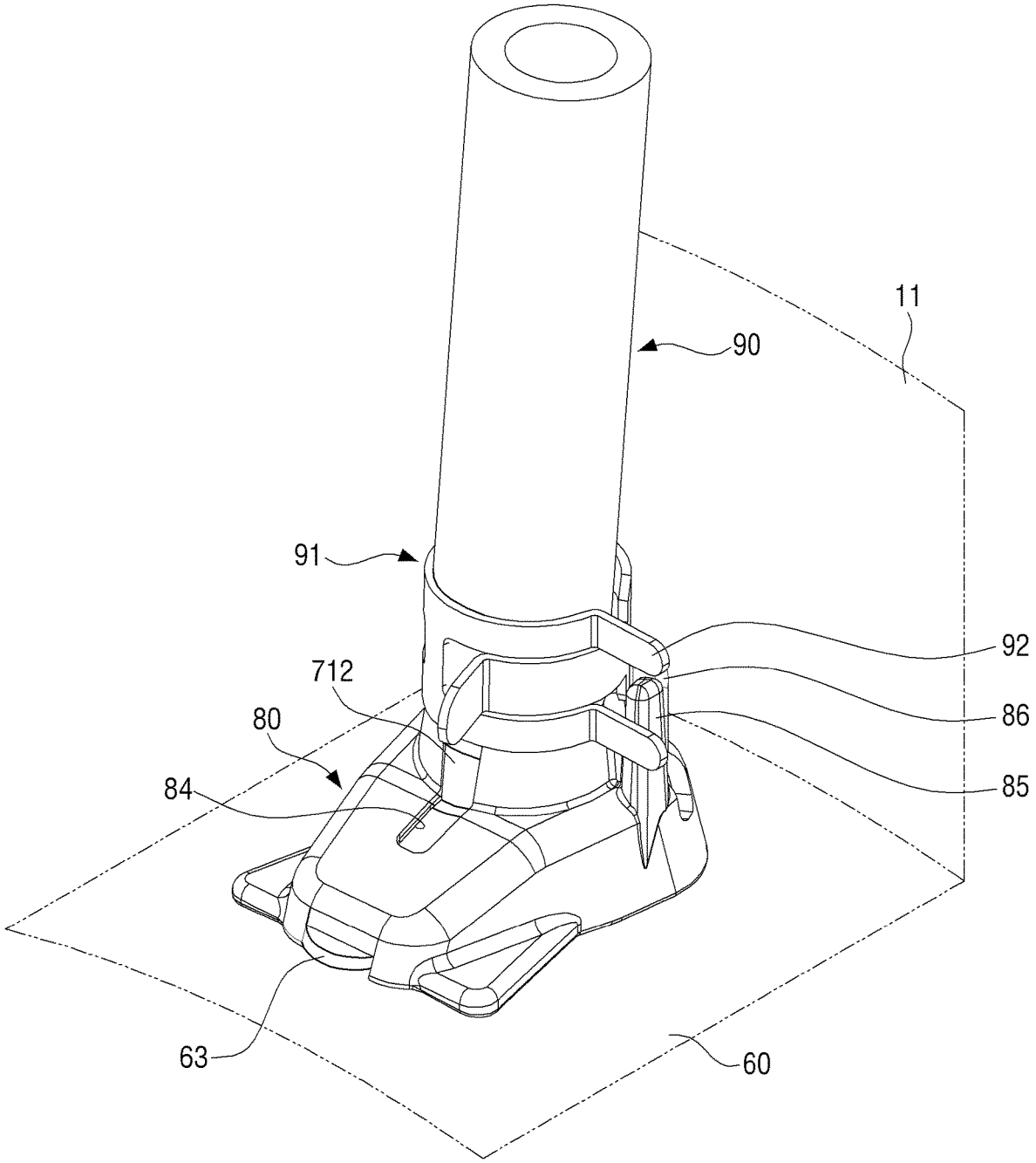
FIG. 12C is a partial perspective view illustrating a relationship between the nozzle guide of FIG. 12A and a hose clamp.

The nozzle guide 80 according to the embodiment illustrated in FIGS. 12A to 12C is the same as that according to the embodiment illustrated in FIGS. 7A to 7C, except the ribs 85 and 86. Thus, the ribs 85 and 86 will only be described below.

Referring to FIGS. 12A to 12C, the ribs 85 and 86 include a lateral-side rib 85 and a front-side rib 86.

The lateral-side rib 85 may be formed to protrude upwardly from the upper surface of the nozzle guide 80 at a lateral side thereof, that is, at one side of the through-hole 81, at a height to interfere with the protrusion 92 of the fixing member 91. As illustrated in FIG. 12C, the lateral-side rib 85 may be formed in the bar shape on the nozzle guide 80 next to one side of the supply hose 90 to face the front frame 11 of the main body 10 together with the supply hose 90. Thus, when the nozzle guide 80 is installed at the outer circumferential surface of the diaphragm 60 such that the longitudinal direction (arrow B) of the nozzle guide 80 is substantially perpendicular to the front frame 11 of the main body 10, the lateral-side rib 85 is provided such that a line which the through-hole 81 and the lateral-side rib 85 form is substantially parallel to the front frame 11. When the supply hose 90 is coupled to the nozzle 70 inserted into the through-hole 81 of the nozzle guide 80, the supply hose 90 and the lateral-side rib 85 are installed side by side while facing the front frame 11 of the main body 10. Thus, the lateral-side rib 85 is not positioned between the supply hose 90 and the front frame 11.

The front-side rib 86 is formed to protrude upwardly from the upper surface of the nozzle guide 80 at the front side thereof adjacent to the front frame 11 of the main body 10 at a height to interfere with the protrusion 92 of the fixing member 91. Thus, the front-side rib 86 is positioned between the through-hole 81 of the nozzle guide 80 and the front frame 11. When the supply hose 90 is coupled to one end of the nozzle 70 protruding out of the through-hole 81 of the nozzle guide 80 as illustrated in FIG. 12C, the front-side rib 86 is formed to be positioned between the supply hose 90 and the front frame 11 of the main body 10.

The front-side rib 86 may be formed of a plurality of barrier walls arranged along a curved line having an identical or similar curvature to the supply hose 90 or the through-hole 81 of the nozzle guide 80. In the embodiment, the front-side rib 86 is formed of two barrier walls.

Each of the plurality of front-side ribs 86 is formed as a curved surface having an identical or similar curvature to the supply hose 90 or the through-hole 81 of the nozzle guide 80. In addition, a width W of the rib 86, that is, a distance between the outermost ends of the plurality of front-side ribs 86 is determined based on a range of positions at which the protrusion 92 of the fixing member 91 is possibly in contact with the front frame 11 of the main body 10 when the protrusion 92 of the fixing member 91 of the supply hose 90 is placed or the protrusion 92 of the fixing member 91 is possibly in contact with the front frame 11 when the diaphragm 60 vibrates during washing. For example, the width W of the front-side rib 86 may be determined to be no greater than the width of the front surface 801 of the nozzle guide 80.

As described above, when the rib is formed on the nozzle guide of the diaphragm assembly according to an embodiment of the disclosure, it is possible to limit or fundamentally prevent the protrusion of the fixing member from being installed at a position where the protrusion of the fixing member is possibly in contact with the front frame of the main body.

Therefore, in case that the washing machine is structured such that the supply hose is installed adjacent to the front frame of the main body, and the protrusion of the fixing member fixing the supply hose is possibly in contact with the front frame, it is possible to fundamentally prevent an occurrence of an assembly failure causing the protrusion of the fixing member to be assembled in contact with the front frame in the washing machine assembly process. Therefore, the washing machine according to an embodiment of the disclosure is capable of preventing noise caused by the assembly failure of the fixing member when the washing machine is used.

The disclosure has been described in an illustrative manner above. It is to be understood that the terminology used herein is for the purposes of illustration, and is not intended to limit the disclosure. The disclosure may be modified and changed in various ways in light of the above teachings. Therefore, the disclosure may be implemented freely within the scope of the appended claims unless specifically described otherwise.

The invention claimed is:

1. A washing machine comprising:

a main body including a front frame;

a tub provided inside the main body;

a diaphragm provided between the tub and the front frame;

a nozzle provided at an inner surface of the diaphragm to spray water toward an inside of the tub;

a fixing protrusion formed on an outer surface of the diaphragm and including a nozzle hole into which one end of the nozzle is inserted;

a supply hose connected to the one end of the nozzle protruding through the nozzle hole;

a nozzle guide detachably provided to cover the fixing protrusion formed on the outer surface of the diaphragm and support one end of the supply hose connected to the one end of the nozzle, and including a through-hole into which the one end of the nozzle is inserted, an annular protrusion provided on a circumference of the through-hole, and a rib formed extend upward from an upper surface of the nozzle guide, wherein the nozzle guide is formed separately from the diaphragm; and a fixing member configured to fix the supply hose to the one end of the nozzle and including a protrusion, wherein the rib is configured to prevent the protrusion of the fixing member from being in contact with the front frame of the main body.

2. The washing machine as claimed in claim 1, wherein the rib is formed on the upper surface of the nozzle guide upwardly at a height to interfere with the protrusion of the fixing member.

3. The washing machine as claimed in claim 2, wherein the rib is formed in a bar shape on the nozzle guide next to one side of the supply hose to face the front frame of the main body together with the supply hose.

4. The washing machine as claimed in claim 3, wherein the rib includes two ribs which are linearly symmetrical with respect to a straight line passing through the center of the through-hole in a longitudinal direction of the nozzle guide.

5. The washing machine as claimed in claim 2, wherein the rib is formed to be positioned between the supply hose and the front frame, while protruding upwardly from the upper surface of the nozzle guide at a front side thereof adjacent to the front frame of the main body.

6. The washing machine as claimed in claim 5, wherein the rib is formed of a plurality of barrier walls arranged at a predetermined interval along a curved line having an identical or similar curvature to the supply hose.

7. The washing machine as claimed in claim 5, wherein the rib is formed of one barrier wall having an identical or similar curvature to the supply hose.

8. The washing machine as claimed in claim 5, wherein the rib has an inner surface facing the supply hose and an outer surface facing the front frame of the main body, the inner surface being perpendicular to a lower surface of the nozzle guide and the outer surface being formed as an inclined surface which is inclined downwardly toward the lower surface of the nozzle guide.

9. The washing machine as claimed in claim 2, wherein the rib is formed to have an upper end positioned at a middle height of the protrusion of the fixing member.

10. The washing machine as claimed in claim 2, wherein the rib includes a lateral-side rib and a front-side rib, the lateral-side rib being formed in a bar shape to protrude upwardly from the upper surface of the nozzle guide at a lateral side thereof at the height to interfere with the protrusion of the fixing member, and the front-side rib being formed to protrude upwardly from the upper surface of the nozzle guide at a front side thereof adjacent to the front frame of the main body at the height to interfere with the protrusion of the fixing member.

11. The washing machine as claimed in claim 2, wherein the fixing member is a one-touch hose clamp, and the protrusion is a push portion of the one-touch hose clamp.

12. The washing machine as claimed in claim 1, wherein the nozzle includes:

a connection portion inserted into the through-hole of the nozzle guide and connected to the supply hose; and a spraying portion extending from the connection portion at a predetermined angle, wherein the connection portion includes a first fixing wing inserted into a fixing groove in the nozzle guide and a second fixing wing inserted into a reference groove in the diaphragm.

13. A diaphragm assembly of a washing machine provided between a front frame of a main body of the washing machine and a tub installed inside the main body thereof, the diaphragm assembly comprising:

a diaphragm provided between the tub and the front frame;

a nozzle provided at an inner surface of the diaphragm to spray water toward the inside of the tub;

a fixing protrusion formed on an outer surface of the diaphragm and including a nozzle hole into which one end of the nozzle is inserted;

a supply hose connected to the one end of the nozzle protruding through the nozzle hole;

a nozzle guide detachably provided to cover the fixing protrusion formed on the outer surface of the diaphragm and support one end of the supply hose connected to the one end of the nozzle, and including a through-hole into which the one end of the nozzle is inserted, an annular protrusion provided on a circumference of the through-hole, and a rib formed to extend upward from an upper surface of the nozzle guide, wherein the nozzle guide is formed separately from the diaphragm;

a hose clamp configured to fix the supply hose to the nozzle and including a push portion, wherein the rib is configured to prevent the push portion of the hose clamp from being in contact with the front frame of the main body.

14. The diaphragm assembly of the washing machine as claimed in claim 13, wherein the rib is formed in a bar shape to protrude upwardly from the upper surface of the nozzle guide at a lateral side thereof at a height to interfere with the push portion of the hose clamp.

15. The diaphragm assembly of the washing machine as claimed in claim 13, wherein the rib is positioned between the supply hose and the front frame, while protruding upwardly from the upper surface of the nozzle guide at a front side thereof adjacent to the front frame of the main body at a height to interfere with the push portion of the hose clamp.

* * * * *